US010226400B2

(12) United States Patent
Kouno et al.

(10) Patent No.: US 10,226,400 B2
(45) Date of Patent: Mar. 12, 2019

(54) MULTI-CELL CONTAINER

(71) Applicant: EA Pharma Co., Ltd., Tokyo (JP)

(72) Inventors: Katsumi Kouno, Shizuoka (JP); Hidetoshi Sakai, Shizuoka (JP); Kaoru Shimizu, Shizuoka (JP); Takahide Kawai, Shirakawa (JP)

(73) Assignee: EA PHARMA CO., LTD., Tokyo (JP)

( * ) Notice: Subject to any disclaimer, the term of this patent is extended or adjusted under 35 U.S.C. 154(b) by 6 days.

(21) Appl. No.: 13/892,783

(22) Filed: May 13, 2013

(65) Prior Publication Data

US 2013/0304016 A1 Nov. 14, 2013

Related U.S. Application Data

(63) Continuation of application No. PCT/JP2012/052053, filed on Jan. 31, 2012.

(30) Foreign Application Priority Data

Jan. 31, 2011 (JP) ..... 2011-018245

(51) Int. Cl.
*A61J 1/10* (2006.01)
*A61J 1/14* (2006.01)
(Continued)

(52) U.S. Cl.
CPC ..... *A61J 1/10* (2013.01); *A61J 1/1475* (2013.01); *A61J 1/2093* (2013.01);
(Continued)

(58) Field of Classification Search
CPC ..... A61J 1/10
See application file for complete search history.

(56) References Cited

U.S. PATENT DOCUMENTS 4,608,043 A * 8/1986 Larkin ..... A61J 1/2093 206/219
5,108,387 A * 4/1992 Falk et al. ..... 604/408
(Continued)

FOREIGN PATENT DOCUMENTS

CN 1082881 A 3/1994
CN 1299263 A 6/2001
(Continued)

OTHER PUBLICATIONS

First Examination Report issued Feb. 24, 2014, in New Zealand Patent Application No. 613886.
(Continued)

*Primary Examiner* — Tatyana Zalukaeva
*Assistant Examiner* — Sara Sass
(74) *Attorney, Agent, or Firm* — Oblon, McClelland, Maier & Neustadt, L.L.P.

(57) ABSTRACT

A multi-cell container includes a bag of substantially flat shape made of flexible film, a partition wall as a separable seal welding opposite inner surfaces of the bag and dividing an inner space of the bag into a plurality of compartments and an inlet-outlet port located at a periphery of the bag so as to be opened to one of the plurality of compartments for introduction and/or discharge of liquid. The partition wall has a horizontal section extending in a direction along the bottom of the bag and a vertical section bent therefrom and extending to the topside of the bag. A first larger volume compartment is formed on one side of the partition wall adjacent the bag bottom and a second smaller volume compartment is formed on the other side of the partition wall. The inlet-outlet port is opened to the first chamber.

10 Claims, 14 Drawing Sheets

(51) Int. Cl.

| | |
|---|---|
| ***A61J 1/20*** | (2006.01) |
| ***B65D 75/56*** | (2006.01) |
| ***B65D 75/58*** | (2006.01) |
| ***B65D 81/32*** | (2006.01) |

(52) U.S. Cl.
CPC ..... *B65D 75/566* (2013.01); *B65D 75/5883* (2013.01); *B65D 81/3266* (2013.01); *A61J 1/2024* (2015.05); *B65D 2575/586* (2013.01)

(56) References Cited

U.S. PATENT DOCUMENTS

| | | | | |
|---|---|---|---|---|
| 5,209,347 | A | 5/1993 | Fabisiewicz et al. | |
| 5,267,646 | A * | 12/1993 | Inoue | A61J 1/2093 206/204 |
| 5,423,421 | A | 6/1995 | Inoue et al. | |
| 5,928,213 | A | 7/1999 | Barney et al. | |
| 5,944,709 | A * | 8/1999 | Barney | A61J 1/10 206/219 |
| 8,845,611 | B2 * | 9/2014 | Tsuruoka | A61J 1/10 604/410 |
| 9,061,819 | B2 * | 6/2015 | Kane, Jr. | B65D 25/08 |
| 2004/0078023 | A1 * | 4/2004 | Gollier | A61J 1/2093 604/410 |
| 2004/0118710 | A1 | 6/2004 | Bourque et al. | |
| 2004/0143005 | A1 * | 7/2004 | Barras | A61K 9/009 514/474 |
| 2004/0188281 | A1 * | 9/2004 | Iwasa | A61J 1/10 206/219 |
| 2007/0106243 | A1 * | 5/2007 | Faries, Jr. | A61J 1/1406 604/404 |
| 2007/0261974 | A1 * | 11/2007 | Balteau | A61J 1/2093 206/219 |
| 2009/0166363 | A1 | 7/2009 | Balteau | |

FOREIGN PATENT DOCUMENTS

| | | | |
|---|---|---|---|
| CN | 1642716 | A | 7/2005 |
| CN | 1649557 | A | 8/2005 |
| CN | 201168199 | Y | 12/2008 |
| CN | 101495163 | A | 7/2009 |
| CN | 101897721 | A | 12/2010 |
| EP | 1 070 495 | A2 | 1/2001 |
| EP | 1621177 | A1 | 2/2006 |
| EP | 2127629 | A1 | 12/2009 |
| JP | 3-122840 | U | 12/1991 |
| JP | 6-14975 | A | 1/1994 |
| JP | A-11-510414 | | 9/1999 |
| JP | 11-285518 | A | 10/1999 |
| JP | 2002-80048 | A | 3/2002 |
| JP | 2003-40282 | A | 2/2003 |
| JP | 2003-104390 | A | 4/2003 |
| JP | A-2006-182436 | | 7/2006 |
| JP | 2007-75276 | A | 3/2007 |
| JP | A-2007-260253 | | 10/2007 |
| JP | 4131266 | B2 | 8/2008 |
| JP | 2009-539522 | A | 11/2009 |
| JP | B-5003037 | | 8/2012 |
| JP | 2007-314245 | A * | 12/2017 |
| WO | WO 02/087675 | A1 | 11/2002 |
| WO | WO 2004/045965 | A2 | 6/2004 |
| WO | WO 2004/058594 | A2 | 7/2004 |
| WO | WO 2004/058594 | A3 | 7/2004 |
| WO | WO 2007/142887 | A1 | 12/2007 |
| WO | WO 2007/144427 | A2 | 12/2007 |

OTHER PUBLICATIONS

International Search Report issued Feb. 28, 2012 in PCT/JP2012/052053 (with English translation).
Combined Chinese Office Action and Search Report issued Nov. 18, 2014 in Patent Application No. 201280007140.0 (with English language translation).
Japanese Office Action issued Nov. 17, 2015 in Japanese Patent Application No. 2012-555874 (with English Translation).
Taiwanese Office Action issued Nov. 19, 2015 in Taiwanese Patent Application No. 101103122 (with English Translation).
European Search Report issued Dec. 23, 2015 in European Patent Application No. 12742501.5.
Japanese Office Action dated Nov. 7, 2017 in Japanese Patent Application No. 2017-006915 (with English translation), 8 pages.
Korean Office Action dated Mar. 21, 2018 in Korean Patent Application No. 10-2013-7014338 (with English translation), 9 pages.

* cited by examiner

MULTI-CELL CONTAINER

CROSS REFERENCE TO RELATED APPLICATIONS

This application is a continuation of PCT/US2012/052053 filed on Jan. 31, 2012 and based upon and claiming the benefit of priority from prior Japanese Patent Application No. 2011-018245, filed Jan. 31, 2011, the entire contents of all of which are incorporated herein by reference.

TECHNICAL FIELD

The present invention relates to a multi-cell container of a type having a plurality of compartments, which are for storing separately respective medicines and which are divided by a partition wall as a separable seal, which is separated and opened for mixing the medicines between the compartments. The present invention is suitable for separate storage of two or more medicines of powder state, which are required to be mixed just before use for keeping stability thereof and is, for example, suitable for storage of polyethylene glycol electrolyte for a preparation treatment in a colonoscopy.

BACKGROUND TECHNOLOGY

In a colonoscopy, a bowel lavage medicine is used for preparative treatment. Such a preparative medicine should be in the form of an aqueous solution for allowing it to be taken by mouth. However, under the aqueous solution, the medicine is subjected to degeneration or coloring with time. Therefore, in an actual shape of product, the medicine of a powder state is tightly stored in a four side seal bag or a self-support bag functioning also as a container for solving the medicine to obtain its solution, which bag is made from soft films. It is, therefore, usual that the bag is opened just before the use and an aqueous solution is obtained for the instant use. See, for example, patent document 1 as far as a container of a soft bag type is concerned, where an application of water is done for obtaining the aqueous solution when used.

In such bowel lavage medicine, which is essentially under a powder state and is solved by water just before the use, a type that includes, in combination, polyethylene glycol (PEG) and electrolyte has conventionally been known. In this type, a large quantity of, at the most, as much as 4 liter is needed, which is highly non-desirable for a people of reduced physical strength, such as an aged person. In view of this, a type of bowel lavage medicine for realizing a reduced quantity of medicine has recently been proposed, in which ascorbic acid (vitamin C) is added to the polyethylene glycol (see patent document 2). This ascorbic acid added type is improved in its bowel lavage ability, so that a reduction of a quantity of medicine to a value between 1 and 2 liter is realized over the large quantity in the prior art of, at the maximum, as much as 4 liter. In short, the ascorbic acid added type is advantageous since a reduction of physical strain is obtained for those who take medicine.

PATENT DOCUMENT 1: Japanese Un-Examined Patent Publication No. 11-285518

PATENT DOCUMENT 2: Publication of Japanese Patent No. 4131266

DISCLOSURE OF THE INVENTION

Problem to be Solved by the Invention

In the patent document 2, the ascorbic acid as well as the polyethylene glycol are under powdered states and are degenerated and/or colored with time when mixed with each other. Therefore, a mixing and solving to water are needed just before use and a container therefor is needed. The patent document 1 discloses a multi-cell container wherein one of medicines is of powdered state and the other medicine is of liquid state. However, a container has not yet been proposed, which is capable of separately storing medicines of powder states and is capable of mixing the medicines and of providing the aqueous solution when used. The present invention is motivated under such an existing state of prior arts.

Means for Solving Problems

A multi-cell container according to the present invention comprises a bag of substantially flat shape made of flexible (soft) film, a partition wall as a separable seal welding opposite inner surfaces of the bag and dividing an inner space of the bag into a plurality of compartments and an inlet-outlet port located at a peripheral portion of the bag so as to be opened to one of the plurality of compartments for introduction and/or discharge of liquid, wherein medicines only of powder states are respectively stored in the plurality of compartments. A liquid is introduced into one of the compartments from the inlet-outlet port to solve the powdered state medicine and a separation of the separable seal causes the solution to be introduced into the rest of the compartment among the plurality of compartments, so that the powdered state medicine stored therein is solved. Preferably, the partition wall is arranged so that it faces, at least partially, a gusseted bottom of the bag. More preferably, the partition wall comprises a first part extending in a direction along the bottom of the bag from its side to a middle location along the width of the bag and a second part extending in a direction opposite to the bottom of the bag from an end of the first part to the top side of the bag. Furthermore, one of the compartments, to which the inlet-outlet port is opened, is located on one side of the partition wall adjacent the bottom of the bag while the other compartment with no provision of inlet-outlet port is located on the side of the partition wall remote from the bottom of the bag. The partition wall may be formed with a rounded shape at a corner portion where the first and second parts are connected with each other. A value of the seal strength of the partition wall may suitably selected and may be: a value, which causes the seal to be separated only by a load as generated by the introduction of the water to one compartment among the plurality of the compartments; a value, which causes the seal to be separated by a shaking operation of the bag after the introduction of the water thereto; or a value, which prevents the seal to be separated by the introduction of the water to the bag but allows the seal to be opened by an additional operation such as a pressing after the water introduction. Finally, the separable seal constructing the partition wall may have a value of seal strength in a range between 1 to 5 N/15 mm.

Effect of the Invention

In the container according to the present invention, medicines of powder states are stored in respective compartments and, from the inlet-outlet port, liquid such as water is introduced to the compartment to which the inlet-outlet port is opened, so that the medicine stored in the compartment is solved to obtain its water solution. The separable seal as the partition wall according to the present invention is weaker than that of a conventional double cell container for storing liquid(s). However, according to the present invention, both of the compartments are for storing, purely, the powdered state medicines and, therefore, the weak separable seal as the partition wall according to the present invention is enough for preventing the seal from being non-intentionally opened by an outside force during a handling of the bag such as a product transfer. However, the weakness of separable seal according to the present invention allows the partition wall to be separated (opened) by a force to the sealed portion as generated when water is introduced for solving the medicine or by an outside force applied by the water solution in the compartment, to which the inlet-outlet port is opened, as generated when the bag is merely shaken. Namely, according to the present invention, a solving and mixing of the powder state medicine in the partition with no provision of the inlet-outlet port is taken place without forcibly applying physical force outwardly. In short, the present invention makes it possible that the powder state medicines are positively maintained in the separate respective compartments during the handling such as a product transfer, on one hand and, on the other hand, the medicines are easily and reliably solved and mixed by merely shaking, i.e., without necessity of any outside pressing when used, thereby preventing erroneous operation from being occurred, which may otherwise cause the medicines to be taken without being mixed.

By constructing the partition wall from a first part extending in a direction along the bottom of the bag from its side to a middle location along the width of the bag and from a second part extending in a direction opposite to the bottom of the bag from an end of the first part to the top side of the bag, it is possible that the bag folded in half does not cause its folded line to be crossed by the partition line, which is advantageous in that the partition wall is prevented from being applied to an unreasonable outside force during its handling such as transportation, which otherwise causes the partition wall to be accidentally separated.

Although the bag's openability depends on the height of the partition wall from the gusseted bottom of the bag, it is found that a value of seal strength of the separable seal as the partition wall in the range between 1 to 5 N/15 mm is desirable from the view point that an accidental opening of the partition wall otherwise caused by handling problem during product transfer is effectively prevented, on one hand and, on the other hand, a bag is reliably and positively opened by a few number of shaking strokes, thereby positively preventing an erroneous operation from being occurred, which otherwise causes the medicine to be taken without being mixed.

EXPLANATION OF REFERENCE NUMBER

10: Bag
10-1, 10-2: Top and Bottom Surface of Bag
10A: Gusseted Bottom of Bag
12: Peripheral Seal (Strong Seal)
14: Opening
15: Handle
16: Inlet-Outlet Port
16-1: Screw Thread Portion
16-2: Flange Portion
18: Partition Wall (Separable Seal)
18-1: Horizontal Section of Partition Wall
18-2: Vertical Section of Partition Wall
18-3: Corner Section of Partition Wall
20: First Compartment
22: Second Compartment
40: Polyethylene Glycol Powder

42: Ascorbic Acid Powder
110, 210, 310, 410, 510, 610: Bag
116, 216, 316, 416, 516, 616: Inlet-Outlet Port
118, 218, 318, 418, 518, 618: Partition Wall
120, 220, 320, 420, 520, 620: First Compartment
122, 222, 322, 422, 522, 622: Second Compartment

FORMS FOR PRACTICING THE INVENTION

In FIGS. 1 to 4 illustrating an embodiment of a multi-cell container according to the present invention in a state where no medicine is stored, the container includes a soft bag 10 of flat shape, which is formed from a polyethylene film by welding followed by cutting. Note: A rear view of the container is not shown because it becomes basically symmetrical with respect to the front view shown by FIG. 1.

Figure 2:
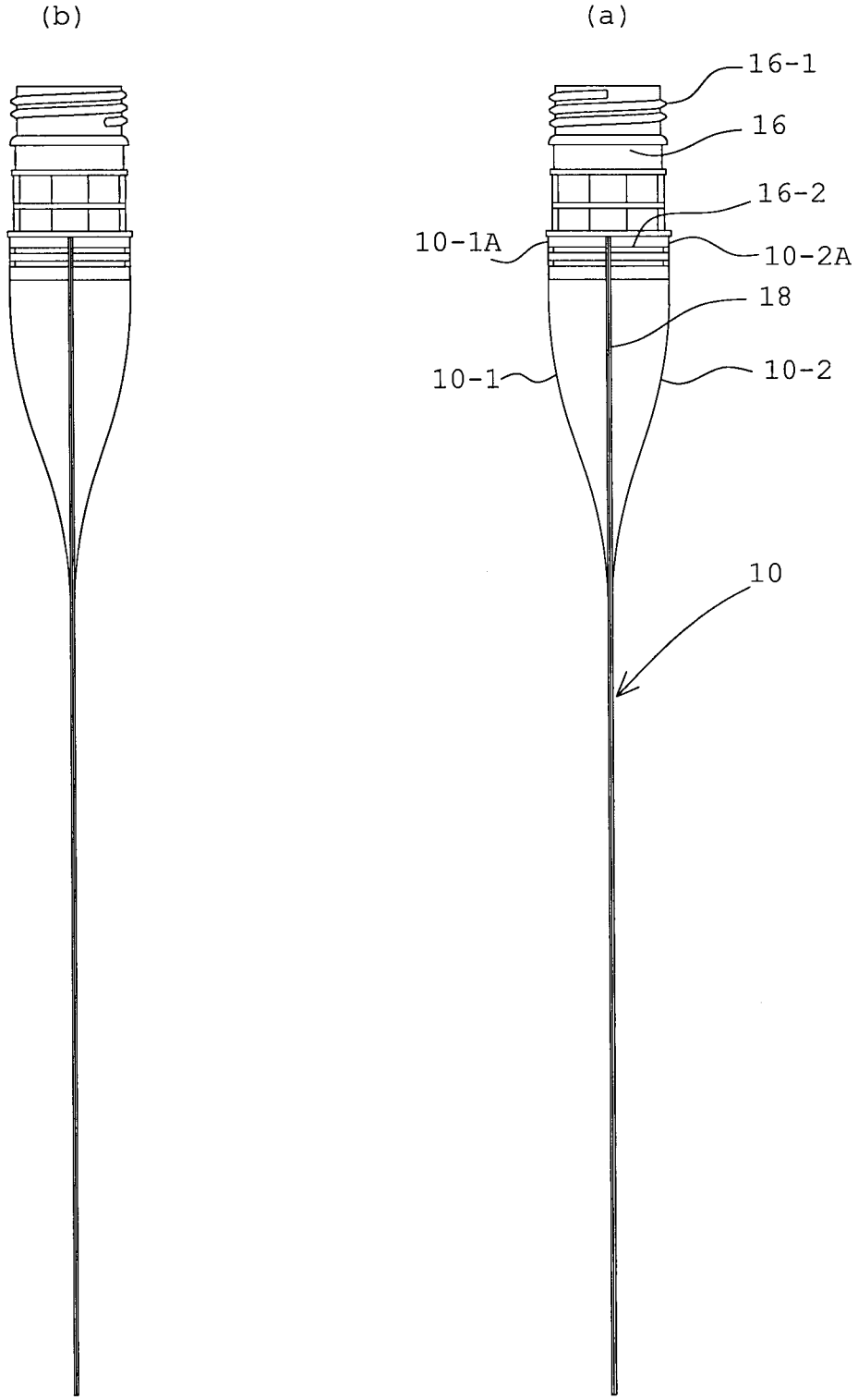
FIGS. 2 (*a*) and (*b*) are right and left side views, respectively, of the multi-cell container shown in FIG. 1.
Figure 3:
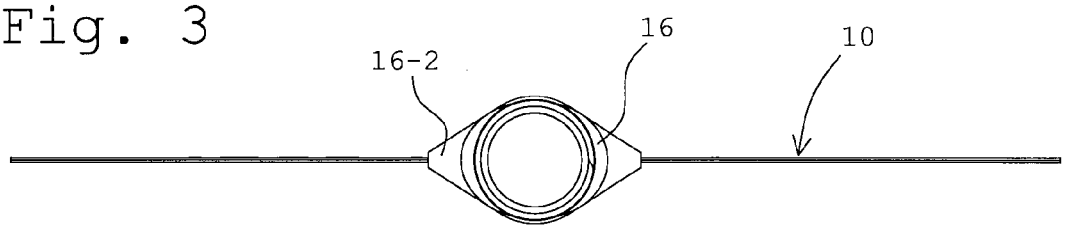
FIG. 3 illustrates a top view of multi-cell container shown in FIG. 1.
Figure 4:
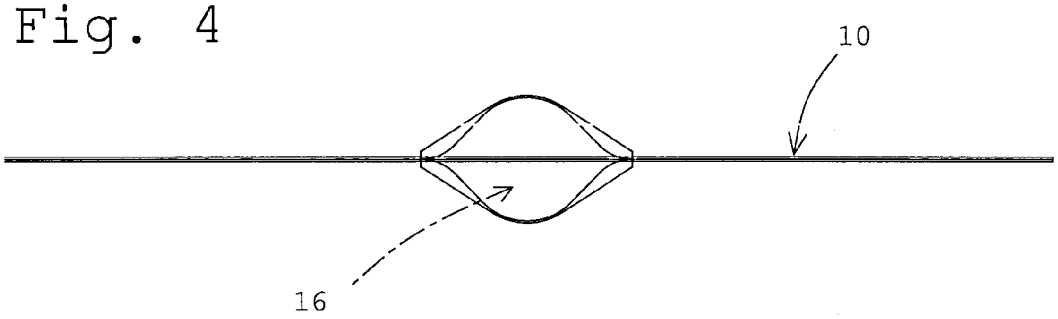
FIG. 4 is a bottom view of the multi-cell container shown in FIG. 1.
Figure 8:
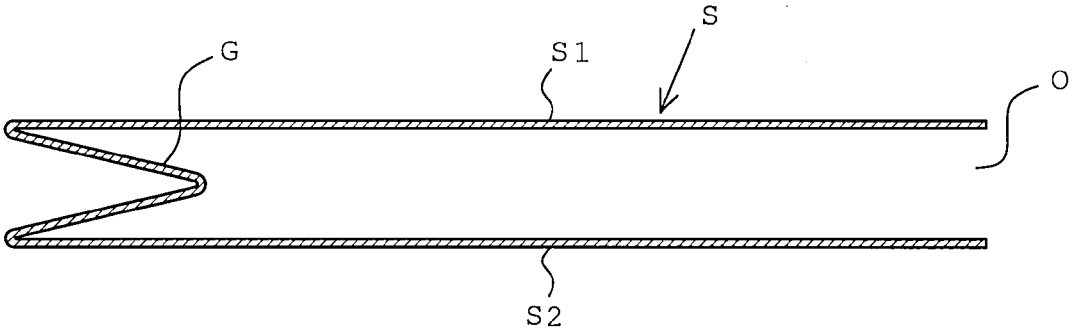
FIG. 8 is a schematic cross sectional view of a folded and gusseted film, which is subjected to a cutting and welding for obtaining a bag for the container of FIG. 1.
Figure 9:
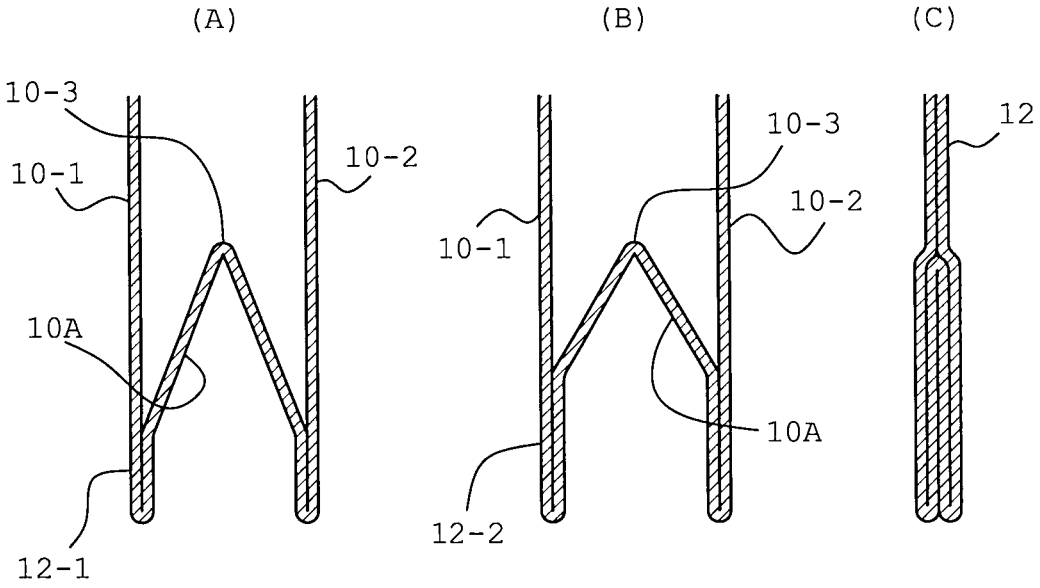
FIGS. 9 (A), (B) and (C) are schematic cross sectional views of the multi-cell container at its gusseted bottom in which the powdered medicines are stored, the views being taken along lines A-A, B-B and C-C, respectively, in FIG. 1.

The polyethylene film, which is, in this embodiment, transparent and which may be colored, is of multi-layered structure of a thickness in a range between 50 to 200μ. In place of the polyethylene, a suitable plastic material such as polypropylene may be used. Along a production line for the bag 10, a sheet of polyethylene film as fed is folded in half as shown in FIG. 8, in which upper and lower faces of the folded sheet S are designated by S1 and S2, respectively and an opening along one side of the sheet is designated by O, non-separable welding (strong seal) of the sheet is done along an outer profile of the bag 10, a separable welding (weak seal) is done for dividing a space inside the bag into a pair of compartments, and, finally, a cutting of the sheet to single bag 10 is done. The folded side of the sheet as fed becomes a bottom of the bag. Namely, the portion of the sheet corresponding to the bag bottom is, as shown in FIG. 8, inwardly folded so that a gusset G is created. The value of thickness of the sheet is, at most, 200μ as described above, which makes the thickness of the film not to be clearly visualized as shown in FIGS. 2 to 4, which is precisely drawn. In view of this, in FIGS. 8 to 11, where the detailed construction of the multi-cell container is explained, the thickness of the film is shown in an exaggerated manner for the clarification of the construction of the bag.

As shown in FIG. 2, the bag 10 after cut and welded from the sheet has opposed top and bottom polyethylene film surfaces 10-1 and 10-2. The top and bottom surfaces 10-1 and 10-2 of the bag correspond to the upper and lower film layers S1 and S2 of the sheet S in FIG. 8. A reference numeral 12 in FIG. 1 denotes an outer profile portion, i.e., a strong seal portion wherein the opposed films 10-1 and 10-2 are welded non-separately. The outer peripheral portion 12 is constructed by welding the opposed surfaces of the polyethylene films 10-1 and 10-2 at a temperature as high as 200° C. so as to obtain non-separable seal at the peripheral portion 12, which allows the powdered medicines and its solution to be held tightly. This welded condition of the top and bottom films at the peripheral portion 12 is illustrated schematically in FIGS. 10 and 11. The gusseted portion G of the blank sheet as shown in FIG. 8 becomes the gusseted bottom 10A of the bag 10 in FIG. 9. The gusseted bottom causes the latter to be widened under the condition where the medicines are stored, which serves the stability of the bag to be increased. The innermost portion of the folded or gusseted portion G of the sheet S corresponds to the portion of the bag 10 designated by a reference numeral 10-3 in FIG. 9. The construction of the peripheral portion 12 at the bottom 10A of the bag will now be further explained with reference to FIG. 9. At the middle of the width of the bottom 10A of the bag 10, the outer peripheral portion (strong seal portion) 12 has the least height as shown by a portion 12-1 in FIG. 9(A). Located nearer the side of the bag, the higher is the height of the outer peripheral seal 12 as shown at a portion 12-2 in FIG. 9(B). As a result, an arch shape of the bottom 10A with the least height at the middle (FIG. 1) is obtained. At the sides of the bag shown in FIG. 9(C), the bag is constructed by non-separately welded four film layers at the gusseted portion and by non-separately welded two film layers at the location above the gusseted portion.

Figure 1:
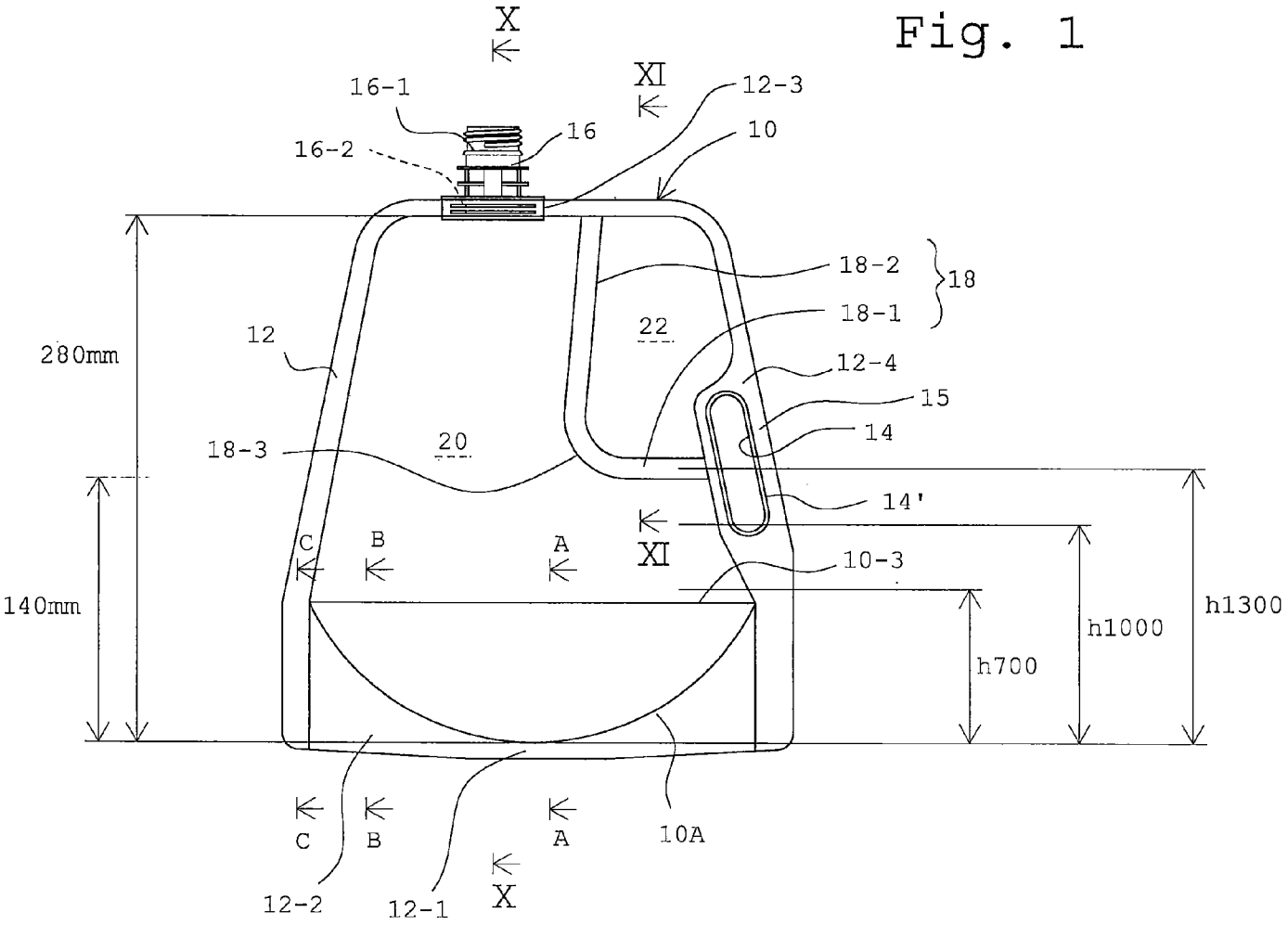
FIG. 1 is a front view of a first embodiment of a multi-cell container in a first embodiment of the present invention in the state where no medicine is stored.

As shown in FIG. 1, the strongly sealed portion 12 has, at a side of bag above the bottom 10A of the bag 10, a slightly inwardly widened portion 12-4, which is formed with an elongated opening 14. The opening 14 is for receiving fingers and the portion of strong seal 12 may serve as a handle. Furthermore, along the entire inner periphery 14' of the opening 14, the top and bottom polyethylene films 10-1 and 10-2 are not welded, which makes the polyethylene films to be locally softer, which is advantageous in that the touch is softened when grasping the handle by inserting fingers to the opening 14.

Figure 5:
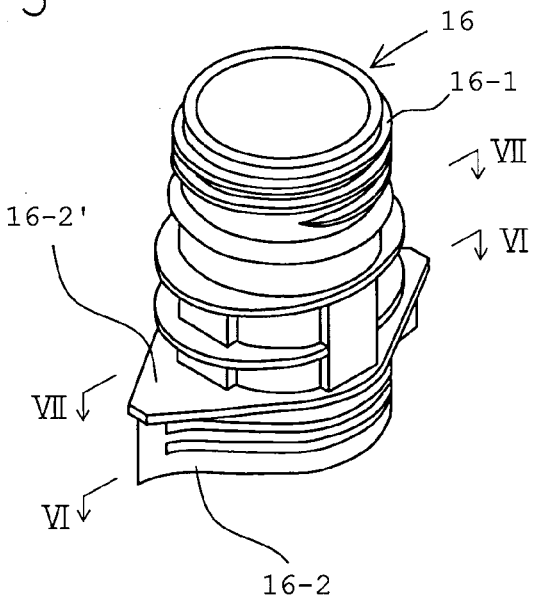
FIG. 5 is a perspective view of an inlet-outlet port in a condition separated from the multi-cell container shown in FIG. 1.
Figure 6:
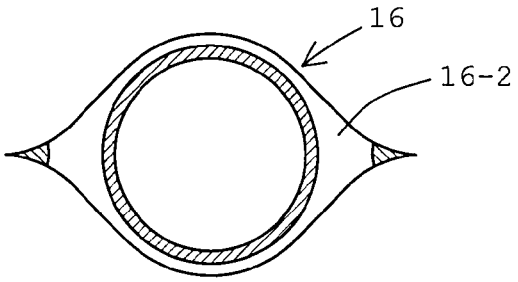
FIG. 6 is a cross-sectional view of the inlet-outlet port taken along lines VI-VI of FIG. 5.
Figure 7:
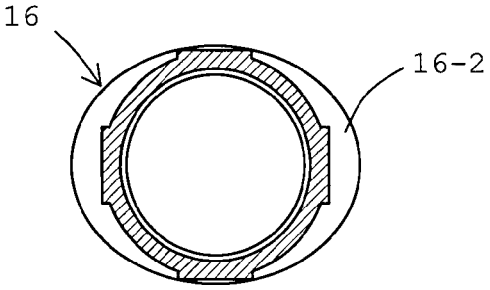
FIG. 7 is a cross-sectional view of the inlet-outlet port taken along lines VII-VII of FIG. 5.

An inlet-outlet port 16 is arranged in the peripheral strong seal 12 at a top location of the bag 10 opposite the bottom 10A. The inlet-outlet port 16 forms essentially a tubular shape opened at its top and bottom and is for introduction of water for obtaining a solution of the powder medicines stored in the bag 10 and for discharging the water solution as obtained by solving the powdered medicines to the water. The inlet-outlet port 16 has rigidity (wall thickness) capable of keeping its tubular shape and is a non-transparent mold product from the same plastic material as that of the bag, i.e., polyethylene, so that a desired welding strength of the port to the bag is obtained. As shown in a perspective view in FIG. 5, inlet-outlet port 16 is formed with a screw thread portion 16-1 at its upper end for screw connection with a closure cap (not shown) and a flange portion 16-2 (FIGS. 2 and 3) at its lower end. As explained above, the sheet S for cutting therefrom a bag is formed with the opening O at the end opposite the gusset G, as shown in FIG. 8. The flange portion 16-2 has an upper expanded part 16-2', which is located inside the opening O when the peripheral strong seal is formed on the inlet-outlet port 16. Namely, the polyethylene films 10-1 and 10-2 have upper ends 10-1A and 10-2A (FIG. 2), which are, at their inner surfaces, subjected to non-separable welding to an upper surface of the flange portion 16-2, so that a welded part 12-3 to the inlet-outlet port 16 is created in the peripheral strong seal 12.

Figure 11:
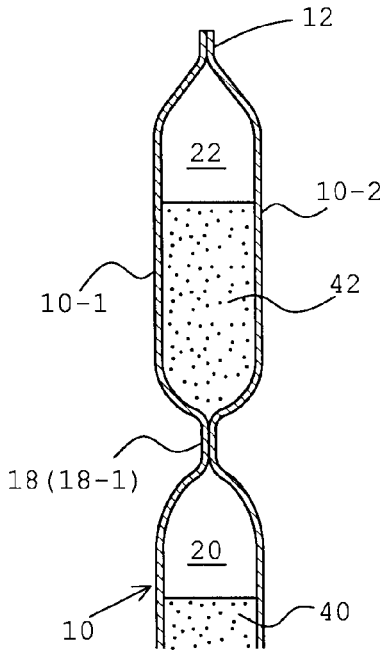
FIG. 11 is a schematic cross sectional view of the container as considered that the powdered medicines are stored, the view being taken along lines XI-XI in FIG. 1.

In FIG. 1, a reference numeral 18 denotes a partition wall as a separable seal (weak seal). The partition wall 18 is constructed by a separable welding of opposed surfaces of the top and bottom polyethylene films 10-1 and 10-2 in the bag 10 at a predetermined width. Such a welding between the top and bottom polyethylene films 10-1 and 10-2 in the partition wall 18 is schematically illustrated in FIG. 11. A value of the welding temperature for obtaining the partition wall 18 is lower than that for obtaining the peripheral strong seal 12, so that the top and bottom polyethylene films 10-1 and 10-2 are separable at the partition wall 18. Furthermore, a welding condition for forming the partition wall 18 is determined by a combination of heating temperature and heating time. The welding condition for obtaining the partition wall 18 is determined by the welding temperature and the welding time. The welding temperature is set to an appropriate value in a range between a softening temperature and a melting temperature of the low melting temperature component in the inner most layer. Namely, the same degree of the seal strength is obtained by increasing seal time when the temperature is low or by reducing seal time when the temperature is high. In other words, an optimum welding condition is obtained by a suitable combination between the welding temperature and welding time. As far as the pressure at the welding process is concerned, it was found that there is no dependency of the welding pressure with respect to the seal strength. What is needed is to merely keep a pressure value high enough to cause the innermost layers of the film to keep contact with each other. In case of the polyethylene films, it was found that desired seal strength is obtained under a welding condition that the welding temperature of the partition wall 18 is in a range between 100-118° C., the sealing time is in a range between 2 to 1.5 seconds and the seal pressure of about 7 kg/cm$^2$. As shown in FIG. 1, the partition wall 18 extends between positions of the peripheral seal 12, i.e., from a side portion inside the handle 15 of the bag 12 to an upper portion of the bag. The partition wall 18 divides the space inside the bag 10 into first and second compartments (cells) 20 and 22. The partition wall 18 is constructed by a substantial horizontal section 18-1 (first portion of the present invention), which extends from the side of the peripheral seal 12 along (opposite) the bottom 10A of the bag and a substantial vertical section 18-2 (second portion of the present invention), which is bent midway from the horizontal portion 18-1 and is connected to the top portion of the peripheral seal 12. As result, the first compartment 20 on the side of the partition wall 18 adjacent the bag bottom 10A is of a large volume, which extends totally from the upper side to the bottom side, of the bag. Contrary to this, the second compartment 22 on the side of the partition wall 18 remote the bag bottom 10A terminates at the middle height of the bag, i.e., remote from the bottom 10A of the bag 10, so that the volume of the second compartment 22 is smaller than that of the first compartment 20. Among the pair of compartments, the inlet-outlet port 16 is opened to the first compartment 20, i.e., the inlet-outlet port 16 is not opened to the second compartment 22. Finally, at a location where the horizontal part 18-1 and the vertical part 18-2 are connected, the partition wall 18 is formed with a rounded (R) corner section 18-3.

Figure 10:
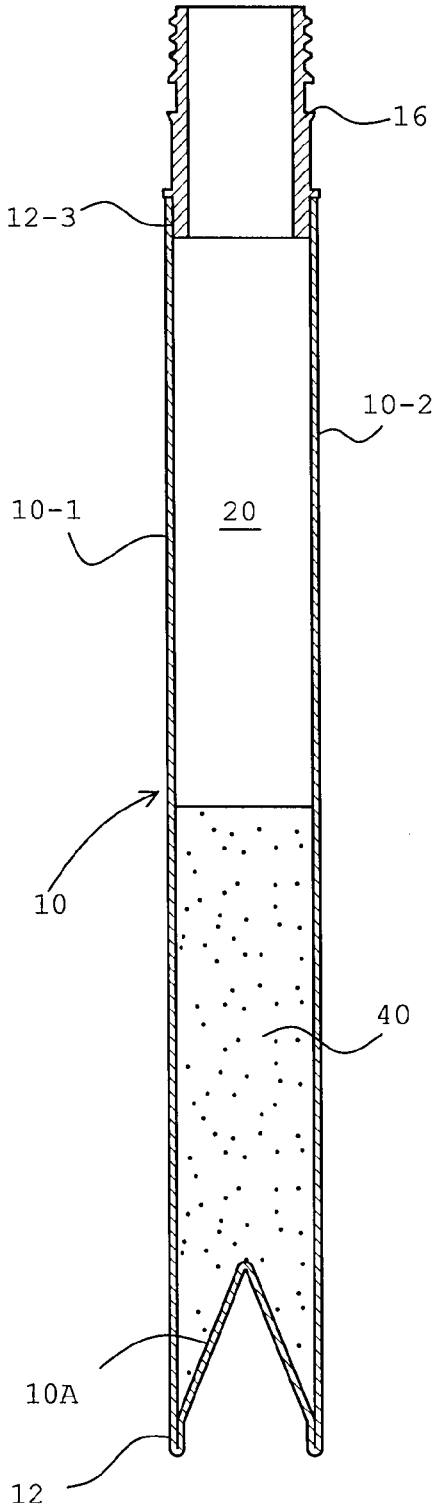
FIG. 10 is a schematic cross sectional view of the container in which the powdered medicines are stored, the view being taken along lines X-X in FIG. 1.

The medicines to be stored by the multi-cell container according to this embodiment are polyethylene glycol electrolyte (polyethylene glycol added by electrolyte) added by ascorbic acid, as bowel lavage medicine (see patent document 2). Both of the polyethylene glycol electrolyte and the ascorbic acid are under powdered states and are colored when mixed with each other. Therefore, a requirement exists that they should be kept separate until just before the use. The present invention aims to fulfill this requirement. Namely, according to this embodiment, the polyethylene glycol electrolyte powder 40 is stored in the first compartment 20 of a larger volume while the ascorbic acid powder 42 is stored in the second compartment 22 of smaller volume. FIGS. 10 and 11 schematically illustrate the conditions of storage of the powder medicines in the first and second compartments 20 and 22, respectively. The bag is shown slightly widened, due to the storage the powdered medicines.

In the multi-cell container for the storage of bowel lavage medicine as an embodiment of a multi-cell container according to the present invention, the polyethylene glycol electrolyte powder 40 and the ascorbic acid powder 42 are stored in the first and second compartments 20 and 22, respectively and the cap is mounted tightly to the inlet-outlet port 16 at the screw thread portion 16-1, so that a finished product for shipping is completed. For the sake of convenience of handling, the bag 10 of the entire height of, for example, 280 mm is folded in double along the middle height of about 140 mm and is stored in a wrapping. A relatively small force can generate a pressure applied to the partition wall 18 via the stored contents thereto, as will be explained later, on one hand. On the other hand, the folded state of the bag may promote a generation of an outside force as accidentally applied to the bag by its handling, such as a transfer. However, it is confirmed that the force applied to the partition seal 18 during the product transfer is not large enough to cause the seal 18 to separate because the stored contents are under powder states both in the compartments 20 and 22. In addition, the horizontal portion 18-1 of the partition wall 18 located adjacent the two-fold line of the bag during the handling extends in horizontal direction and does not cross the two-fold line, which makes it less likely that the partition wall 18 is accidentally opened during its handling such as a product transfer.

Now, a manner of use of the embodiment of the multi-cell container is explained. From the port 16 tightly sealed by the cap (not shown), the latter is turned and removed, and, a desired amount of distilled water is introduced into the first cell 20 via the port 16, so that the polyethylene glycol electrolyte powder 40 are solved by the introduced water so as to obtain its water solution. Then, an opening operation of the partition wall 18 is done for causing the ascorbic acid powder 42 in the second cell 22 to be solved by the water solution in the first cell 20. In this opening operation, the introduction of water into the first compartment 20 causes, itself, an erosion to be initiated in the partition wall 18, which may force the latter to open. Such erosion by the introduction of water is, even, enough to completely open the partition wall 18 when the seal strength of the partition wall 18 is weak. According to the present invention, the first and second compartments 20 and 22 store therein just powdered medicines and, therefore, it is possible that such weak setting of the degree of seal strength, that makes the seal to open just by the introduction of the water, does not cause the partition wall 18 to be non-intentionally opened if subjected to any outside force during a handling, such as a product transfer. However, such a weak setting makes it difficult to determine whether the separation of the partition wall 18 as occurred is generated intentionally by the introduction of water into the first compartment 20 or non-intentionally by handling during the product transfer. Such a difficulty must be avoided in order to prevent an erroneous operation from being occurred. In view of this, in the practice of the present invention, the setting of the seal strength of the partition wall 18 is such that no opening occur by a mere introduction of water and an intentional operation for opening the seal can only make the seal to open. In order to obtain such intentional opening, the bag 10, to which first compartment 20 the water introduced has been completed, may be subjected to shaking in the vertical or horizontal direction, which causes a liquid pressure to be generated, which is enough to make the partition wall 18 to open. Namely, a pressing operation from the outside by an operator's palm is not always necessary for carrying out the intentional opening operation, as is the case in a conventional bag where a liquid medicine is stored in at least one compartment.

Now, a result of tests as to the seal strength of the partition wall 18 will be explained. Multi-layer polyethylene films of thickness of 145 μm were subjected to a non-separable welding at temperature of 200° C. along the outer profile of a bag in order to form a peripheral seal 12 (FIG. 1) and subjected to a separable welding at a temperature in a rage of 100 to 118° C. at the width of 10 mm in order to form a partition wall 18 having a horizontal portion 18-1 and a vertical portion 18-2, so that a bag having a first compartment 20 of a volume of 2500 mL as the maximum amount of water to be filled therein and of a height of 280 mm was created. Furthermore, in order to determine how a value of radius of the rounded corner 18-3 connecting the horizontal and the vertical portions 18-1 and 18-2 influences to the seal separation performance, samples of different values of radius of the rounded corner portion of 20 mm and 30 mm were prepared. In addition, in order to determine a desired value of the seal strength of the partition wall 18, samples of gradually changed values of a seal strength were prepared, which is evaluated by a force (Newton) needed for separation of the seal per width of the seal of 15 mm in conformity of JIS (Japanese Industrial Standard) Z 0238. The test for the openability was done under the condition that the first compartment 20 is filled with water. Furthermore, in order to decide the effect of vertical position of the horizontal section 18-1 to the openability (separation) of the seal, samples of three different values of the height H of the horizontal section 18-1 were prepared. Note: the height H of the horizontal section 18-1 is defined by volume at a half height of 140 mm with respect to the full height of 280 mm of the bag, which is referred herein as a "half height volume". In the lowest position of the horizontal section 18-1, the height H ($=H_{700}$) of horizontal section 18-1 is such that the half height volume is 700 mL. In the middle position of the horizontal section 18-1, the height H ($=H_{1000}$) of horizontal section 18-1 is such that the half height volume is 1000 mL. Finally, in the highest position of the horizontal section 18-1, the height H ($=H_{1000}$) of horizontal section 18-1 is such that the half height volume is 1300 mL, i.e., $H=H_{1300}$. In FIG. 1, the partition wall 18, of which horizontal section 18-1 located at the highest position of the height H equal to $h_{1300}$, is illustrated. As to the partition wall 18, of which horizontal section 18-1 located at the middle height position of the height H equal to $h_{1000}$ or the lowest position of the height H equal to $h_{700}$, the respective position of the horizontal section 18-1 of the partition wall 18 is illustrated only by respective phantom line L' or L". As for an evaluation of openability, a shaking stroke number test was conducted. Note: The shaking stroke number test is constructed by: introducing, into the first compartment, an amount of water of 1000 mL slightly short of the half of the full amount equal to 2500 mL to the first compartment 20; holding, by his or her right hand, the inlet-outlet port 16, to which the closure cap is mounted and, by his or her right hand, the bottom 10A at a location adjacent the second partition 22, and; vertically shaking the bag at an amplitude of 20 cm and counting the number of shaken strokes until the completion of a separation of the partition wall 18 at its rounded portion 18-3. The mean value of stroke numbers for 5 samples is obtained for the evaluation. Table 1 illustrates results of stroke number test with respect to the values of seal strength for the lowest, the middle and highest positions $h_{700}$, $h_{1000}$ and $h_{1300}$, respectively when the radius of the rounded corner 18-3 is 20 mm. Table 2 illustrates the similar results when the radius of the rounded corner 18-3 is 30 mm.

TABLE 1

| (20R) | | | | | |
|---|---|---|---|---|---|
| $h_{700}$ | | $h_{1000}$ | | $h_{1300}$ | |
| Seal Strength | Stroke Numbers | Seal Strength | Stroke Numbers | Seal Strength | Stroke Numbers |
| 0.95 | 0 | 1.05 | 0 | 1.25 | 1.8 |
| 1.87 | 0 | 1.78 | 0 | 1.8 | 1.6 |
| 2.87 | 0 | 2.67 | 0.8 | 2.38 | 4 |
| 3.92 | 1 | 3.78 | 1.4 | 3.02 | 10 |

TABLE 1-continued

| (20R) | | | | | |
|---|---|---|---|---|---|
| $h_{700}$ | | $h_{1000}$ | | $h_{1300}$ | |
| Seal Strength | Stroke Numbers | Seal Strength | Stroke Numbers | Seal Strength | Stroke Numbers |
| 4.69 | 1.2 | 4.82 | 3.2 | 3.59 | 8.2 |
| 6.14 | 2.8 | 7.56 | 16.8 | 4.35 | 14.8 |

TABLE 2

| (30R) | | | | | |
|---|---|---|---|---|---|
| $h_{700}$ | | $h_{1000}$ | | $h_{1300}$ | |
| Seal Strength | Stroke Numbers | Seal Strength | Stroke Numbers | Seal Strength | Stroke Numbers |
| 2.01 | 0.4 | 1.87 | 1.2 | 1.78 | 1 |
| 2.81 | 0.8 | 2.1 | 0.8 | 3.3 | 2.2 |
| 3.42 | 1 | 3.12 | 3.6 | 4.01 | 6 |
| 4.58 | 1 | 3.7 | 3 | 5.01 | 14.2 |
| 6.12 | 1 | 4.3 | 12.8 | 7.11 | 100 |

The test results will now be studied. When the height H of the horizontal portion 18-1 of the partition wall 18 is $h_{700}$, the top level of the filled water of quantity of 1000 mL is located considerably above horizontal section 18-1. In this case, an opening of the partition wall 18 can be taken place the most easily. Especially, the seal strength equal to or lower than 3 (N) is enough to cause the seal to be separated even without any shaking of the bag, i.e., can initiate the seal separation merely by an introduction of the water of the amount of 1000 mL into the first compartment 20. In the seal strength of around the value of 4 (N), one or two strokes of the shaking operation are enough for opening. Namely, the amount of water of 1000 mL is enough to fill the first compartment 20 at a level fully above the horizontal section 18-1 of the partition wall 18, which allows the shaking action strongly urges the gusseted bottom 10A to be widened, so that a separation (opening) of the seal is initiated from the rounded portion 18-3. A value of seal strength as high as about 6 (N) does not prevent the rounded portion 18-3 from being separated and a partially non-separated portion is, however, left in the straight section 18-2 above the rounded corner portion 18-3.

When the height of the horizontal section 18-1 of the partition wall 18 is $h_{1000}$, the top level of the filled water of an amount of 1000 mL is located at just around the horizontal section 18-1. The force for separating the seal constructing the partition wall 18 for opening the bag 10 as generated by the shaking is lowered as compared with that is obtained by the height H equal to $h_{700}$. However, the force is still high and therefore the mere introduction of water to the first compartment 20 may open the seal without the shaking so long as the seal strength is 2 (N) or less. When a shaking is accompanied, the commencement of the seal separation at the corner portion 18-3 is possible when the seal strength is increased to 7.5 (N) while, however, the portion of the seal above the corner section is difficult to separate, i.e., non-separated portion is left in the straight section 18-2 of the partition wall 18.

When the height of the horizontal section 18-1 of the partition wall 18 is $h_{1300}$, the top level of the filled water of an amount of 1000 mL is located fairly below the horizontal section 18-1. In this case, the force of filled water of amount of 1000 mL for urging the bag bottom 10A to stretch or to widen is small and therefore mere introduction of the water cannot cause the seal to open even when the seal strength is as small as 1 (N). Furthermore, even when the seal strength is merely increased to value of about 4 (N), 20 strokes or more of the shaking are needed to make the seal to open. Such a large number of shaking is likely to give the user a impression that the bag is difficult to open prior to the completion of the opening and induces him or her to execute an additional operation for opening other than mere shaking, i.e., outside pressing operation.

Figure 12:
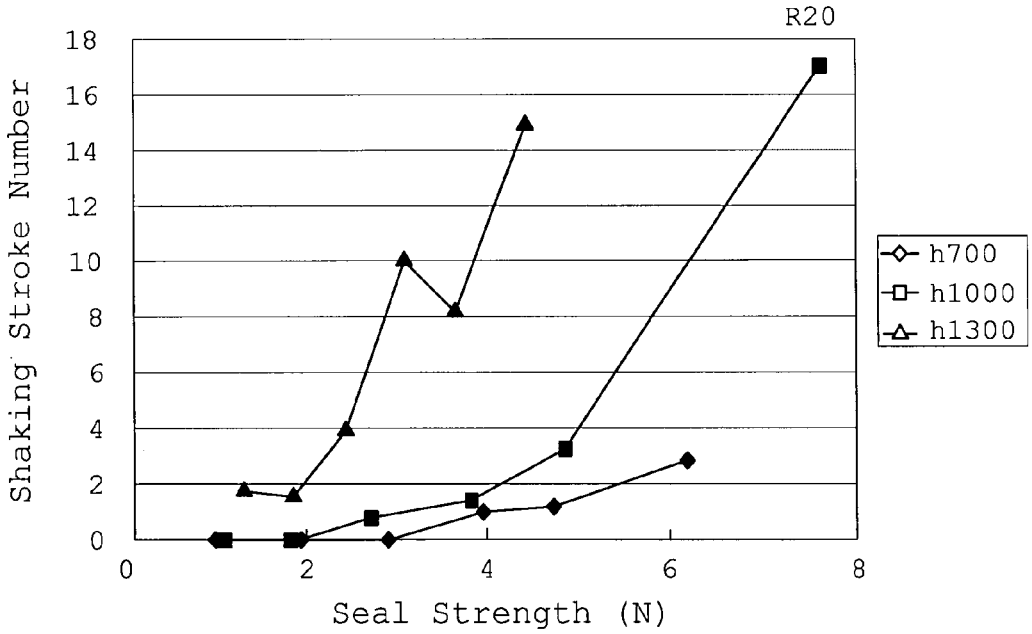
FIG. 12 is a graph showing relationship between seal strength of a separable seal constructing a partition wall of the container according to the present invention and a number of shaking stroke for causing the partition wall to be separated and opened when a value of radius of the rounded corner of the separable seal is 20 mm.
Figure 13:
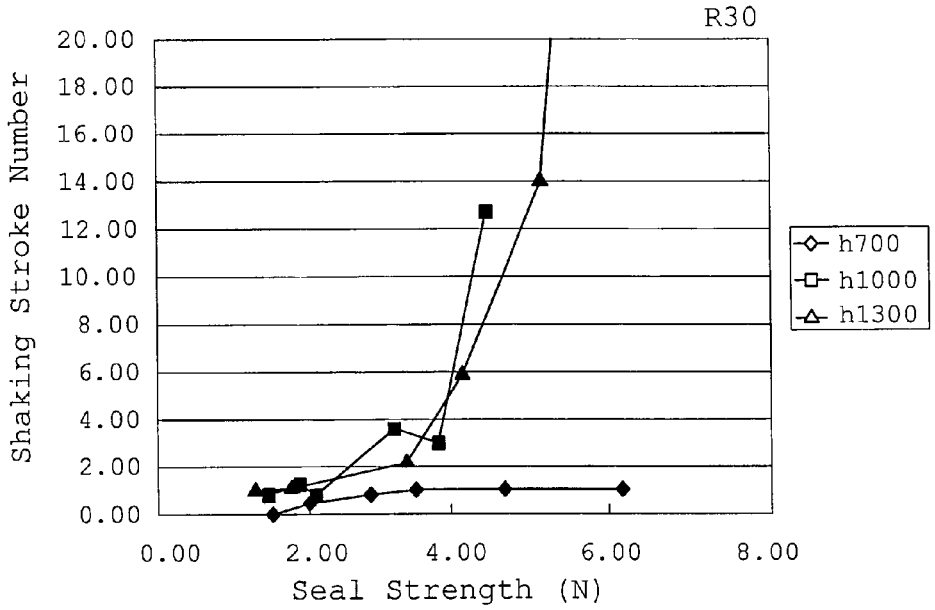
FIG. 13 is similar to FIG. 12 but shows when a value of radius of the rounded corner of the separable seal is 30 mm.

From the table 1, FIG. 12 illustrates a relationship between the seal strength and the shaking stroked number when the radius R is 20 mm while FIG. 13 illustrates a relationship between the seal strength and the shaking stroke number when the radius R is 30 mm. From these results it may clearly concluded that there exists a general relationship that increased seal strength may cause the shaking number to increase, i.e., make the seal difficult to open. As far as the seal height position is concerned, a lowered seal height may cause the shaking stroke number to be reduced, i.e., make the seal easy to open. As to the radius R of the corner portion 18-3, a reduced value of the radius will make the seal to open easily due to a corrosion taken place at the corner portion. However, no influence to the openability was found so long as the lowered value of radius R is 20 mm or so.

Figure 14:
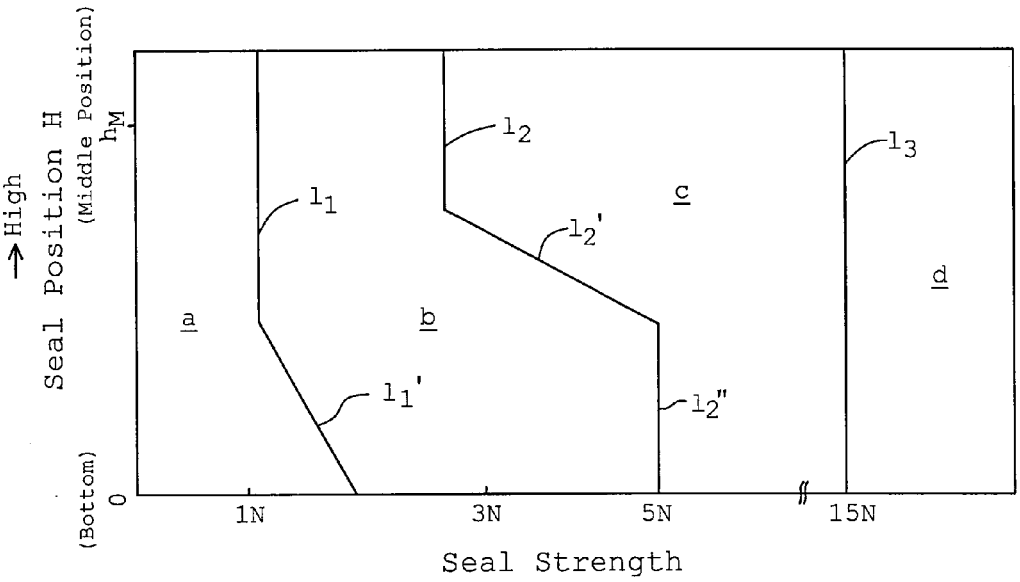
FIG. 14 is a diagram illustrating visually an operating characteristic of multi-cell container according to the present invention with respect to seal strength and height of the seal.

A diagram of FIG. 14 illustrates, visually, the opening operation of the embodiment of the multi-cell container according to present invention, wherein the abscissa is seal strength (N/15 mm) and the ordinate is a height of the straight section 18-1 of the partition wall 18 from the bottom of the bag. A middle position along the height of the bag 10 is designated by $h_M$. An area designated by a, of which seal strength value is smaller than a value on a boundary line $l_1$ of a value around 1N is referred as a low seal strength area where the partition wall may open without any shaking operation. Namely, in the low seal strength area a, a mere introduction of the water can initiate the seal to open and, therefore, is inappropriate. This area a is inappropriate also because there exists a possibility of non-intentional opening of the partition wall as initiated when subjected a movement during handling such as transfer. As explained above, a lower seal height causes the partition to open more easily and, therefore, a displacement of the boundary line to the side of a value of seal strength larger than 1N as shown by $l_1'$ is obtained. In FIG. 14, a line $l_2$ indicates a boundary of a value of seal strength, above which a mere introduction of water plus shaking of the bag cannot initiate the separation of the partition wall 18, i.e., an outside pressing of a portion of the first compartment 20 filled with the water is essential to make the seal 18 to open. In other words, in an area between the lines $l_1$ and $l_2$ designated by b, a separation of the partition wall 18 can be initiated only by a shaking operation. In other words, the area b is the most appropriate seal strength zone for practicing the present invention. The value of the seal strength along the line $l_2$ is of around 3N at a higher side of the seal position. However, on the lower side of the seal position, the partition wall becomes easy to open, so that the boundary seal strength line is displaced to the side of a value larger than 3N, as shown by line $l_2'$ and finally of a value larger than a value of 5N, as shown by line $l_2''$. A line $l_3$ illustrates a boundary line of value of seal strength of around 15N, above which an outside pressure applied from the outside to a portion of the first compartment 20 filled by a water solution cannot make the partition wall 18 to open. Therefore, the area designated by c located between the lines 12 and 13 is the area where a mere shaking operation is not enough and an outside forced pressing operation is additionally needed in order to make the seal to open. Finally, an area d of a value of the seal strength higher than the value on the line $l_3$ is an area where any opening of the seal cannot obtained irrespective of an application of outside pressing force. In view of the above, it is concluded that a desired range of the seal strength of the separable seal as the partition wall 18 is between 1 to 5 (N) while taking the effect of the height of its horizontal section 18-1 into the consideration, which may influence to the opening characteristic of the partition wall 18.

Furthermore, a vibration test and a drop test were done for checking suitability during the product transfer. The vibration test is based on the random vibration test stipulated JIS Z 0232 with the vibration time of 60 minutes. An evaluation of the result of the vibration test was done by visually inspecting whether or not an opening occurs for 40 bags of each of the values of seal strength of 0.78, 1.17 and 2.14 N/15 mm, respectively. For the 40 bags for each of values of seal strength subjected to the test, any bag with seal opened could not found.

In view that all of the bags subjected to the vibration test could maintain the seal, the same bags were subsequently subjected to a drop test, which was done by dropping a bag from the height of 90 cm and the dropping is repeated for tree times. For the 40 bags of each of the values of seal strength of 0.78, 1.17 and 2.14 N/15 mm, respectively, any bag with seal opened could also not found. From the result of the vibration test and the drop test, it is understood that the minimum value of the steal strength as small as 0.78 N/15 mm is enough to prevent the seal from being separated with respect to the load as generated when subjected to a dropping. This minimum value of the steal strength of 0.78 N/15 mm has a sufficient margin with respect to the minimum value of 1 N/15 mm in the preferable range of seal strength 1 to 5 N/15 mm during the opening operation by the shaking or pressing as explained with reference to FIG. 14, which proves a desired transportation ability of the container according to the present invention.

Figure 15:
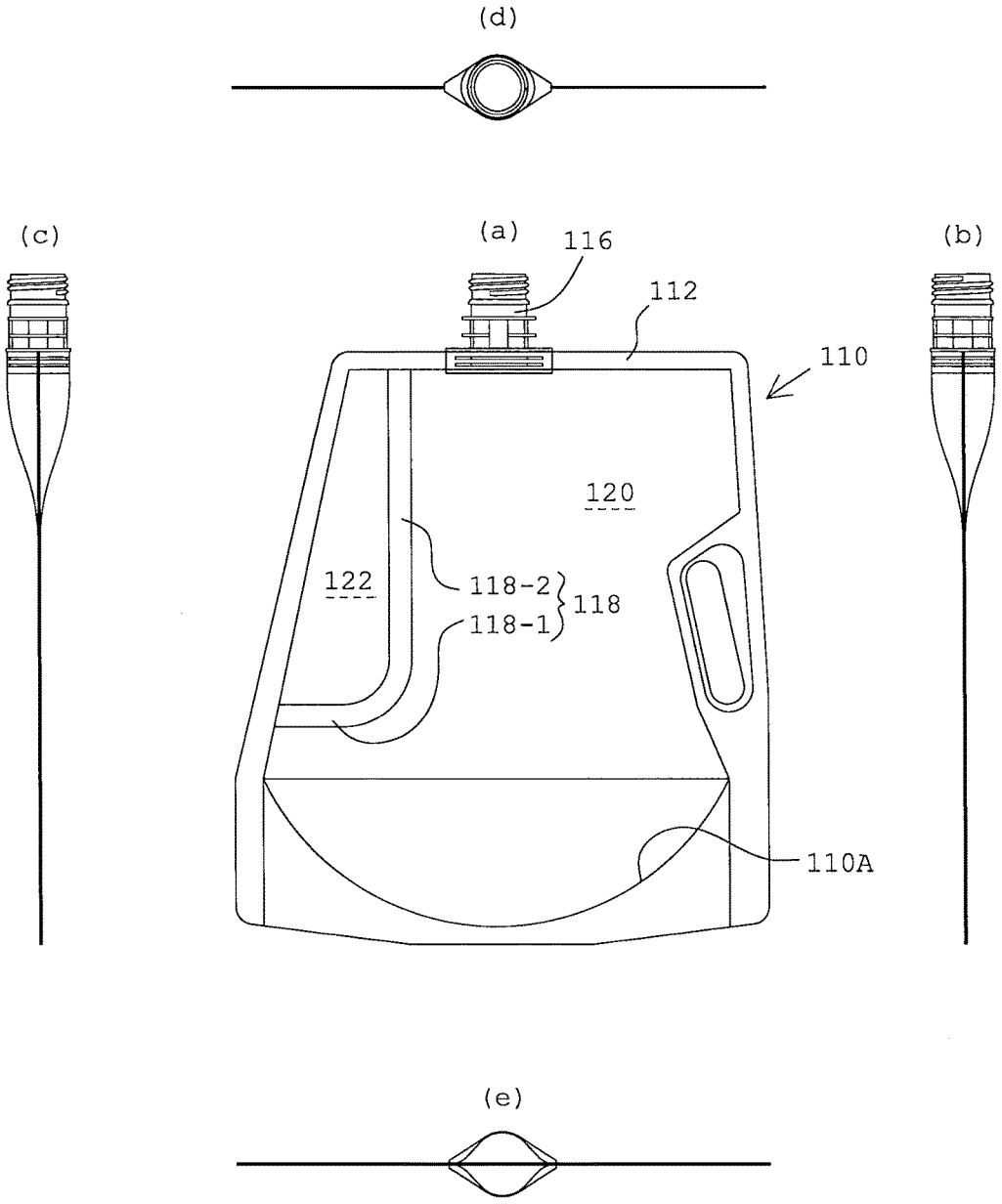
FIGS. 15 (*a*), (*b*), (*c*), (*d*) and (*e*) are front view, right side view, left side view, top view and bottom view, respectively, of a multi-cell container in another embodiment of the present invention in the state where no medicine is stored.

FIG. 15 illustrates another embodiment of a multi-cell container according to the present invention, having a bag 110 has a peripheral seal 112 (non-separable seal), on which an inlet-outlet port 116 is mounted and a partition wall 118 as a separable seal having a horizontal section 118-1 and a vertical section 118-2. The partition wall 118 separates the space inside the bag 110 into first and second compartments 120 and 122 as is similar to the first embodiment. As also similar to the first embodiment (FIG. 9), the bag 110 has a gusseted bottom 110A. What is different from the first embodiment is in an outer profile of the peripheral seal 112 and a manner of an arrangement of the partition wall 118. However, these functions are unchanged. In this embodiment as well as the following embodiments, rear views are omitted for simplicity because the rear views different from the front views only in that the rear views are symmetric with respect to the front views except for screw portions at the tops. Note: In the rear view, the screw portion should be illustrated so that it is rotated 180 degree from that shown in the front view.

Figure 16:
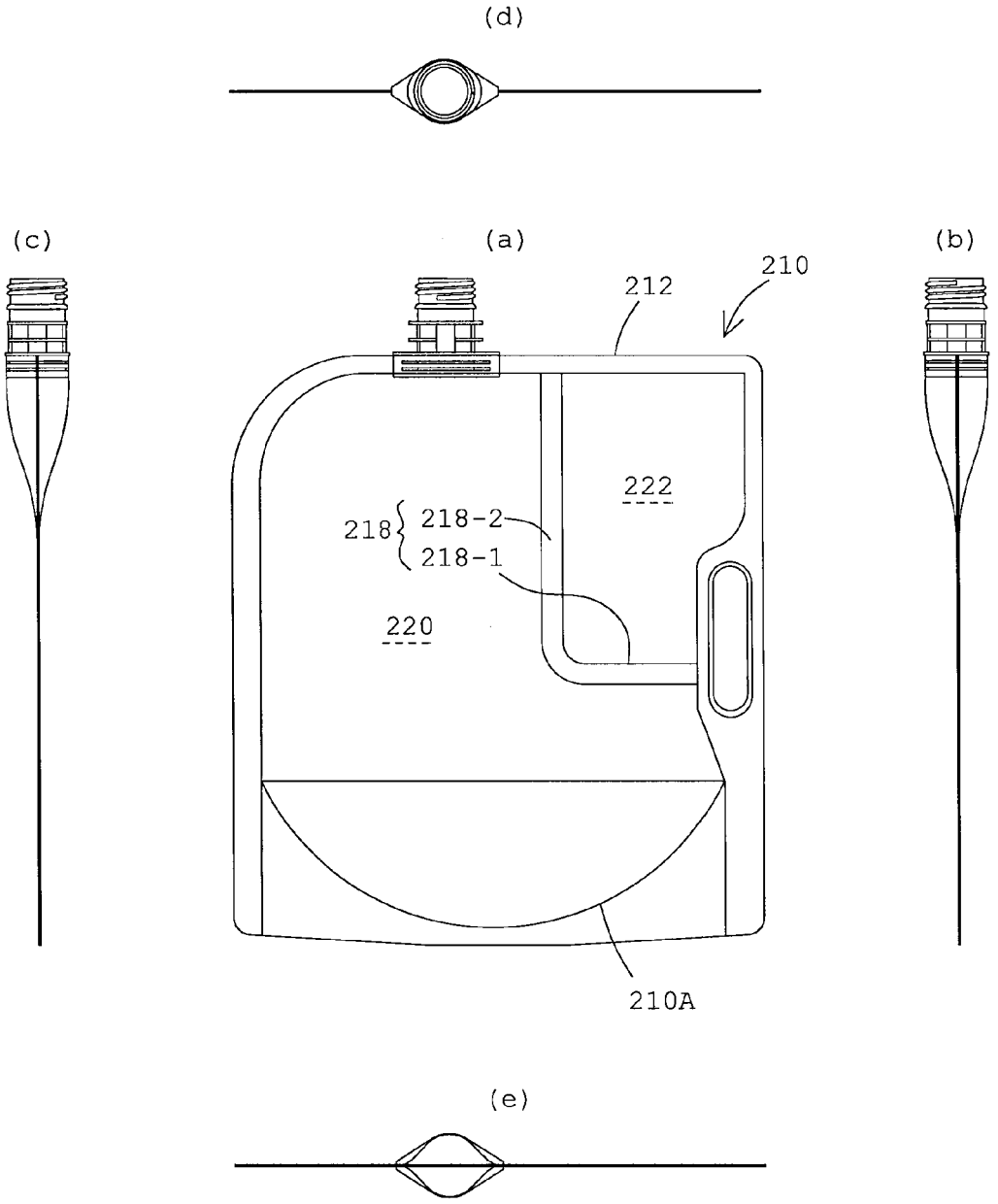
FIGS. 16 (*a*), (*b*), (*c*), (*d*) and (*e*) are front, right side, left side, top and bottom views, respectively, of a multi-cell container in another embodiment of the present invention in the state where no medicine is stored.

FIG. 16 illustrates further another embodiment of a multi-cell container according to the present invention, having a bag 210 has a peripheral seal 212 (non-separable seal), on which an inlet-outlet port 216 is mounted and a partition wall 218 as a separable seal having a horizontal section

218-1 and a vertical section 218-2. The partition wall 218 separates the space inside the bag 210 into first and second compartments 220 and 222 as is similar to the first embodiment. As also similar to the first embodiment (FIG. 9), the bag 210 has a gusseted bottom 210A. What is different from the first embodiment is in an outer profile of the peripheral seal 212 and a manner of an arrangement of the partition wall 218. However, these functions are unchanged.

Figure 17:
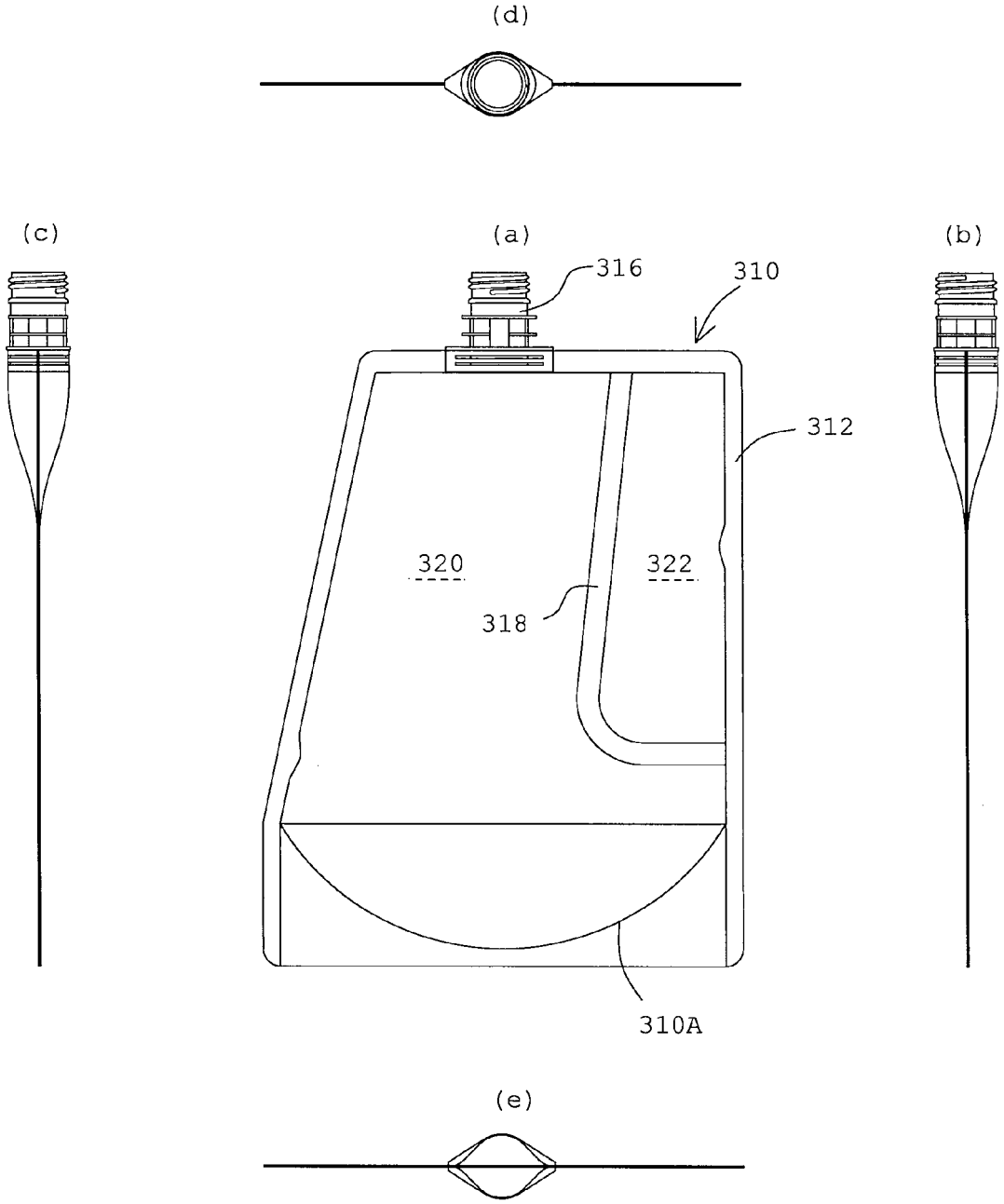
FIGS. 17 (*a*), (*b*), (*c*), (*d*) and (*e*) are front, right side, left side, top and bottom views, respectively, of a multi-cell container in another embodiment of the present invention in the state where no medicine is stored.
Figure 18:
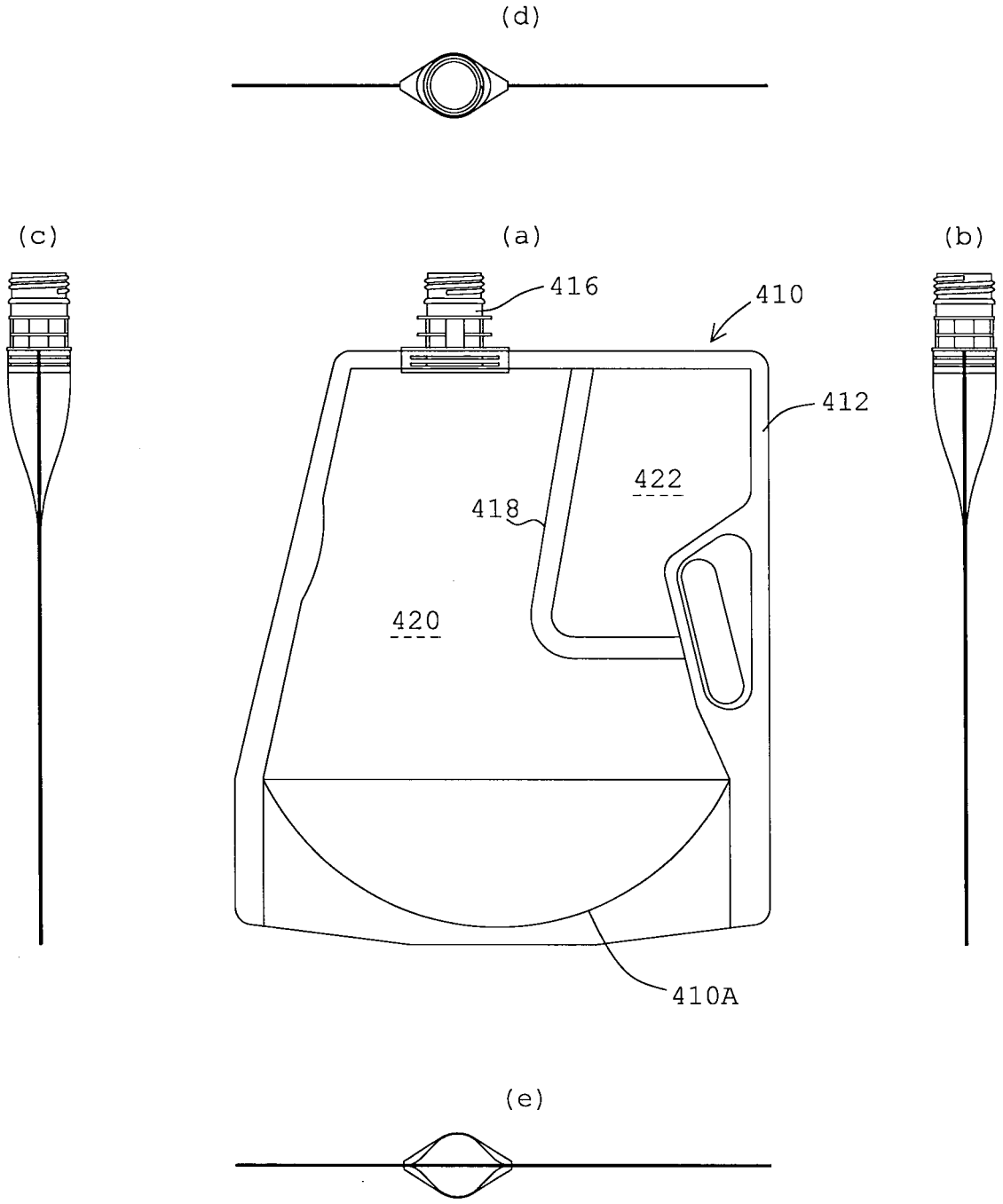
FIGS. 18 (*a*), (*b*), (*c*), (*d*) and (*e*) are front, right side, left side, top and bottom views, respectively, of a multi-cell container in another embodiment of the present invention in the state where no medicine is stored.
Figure 19:
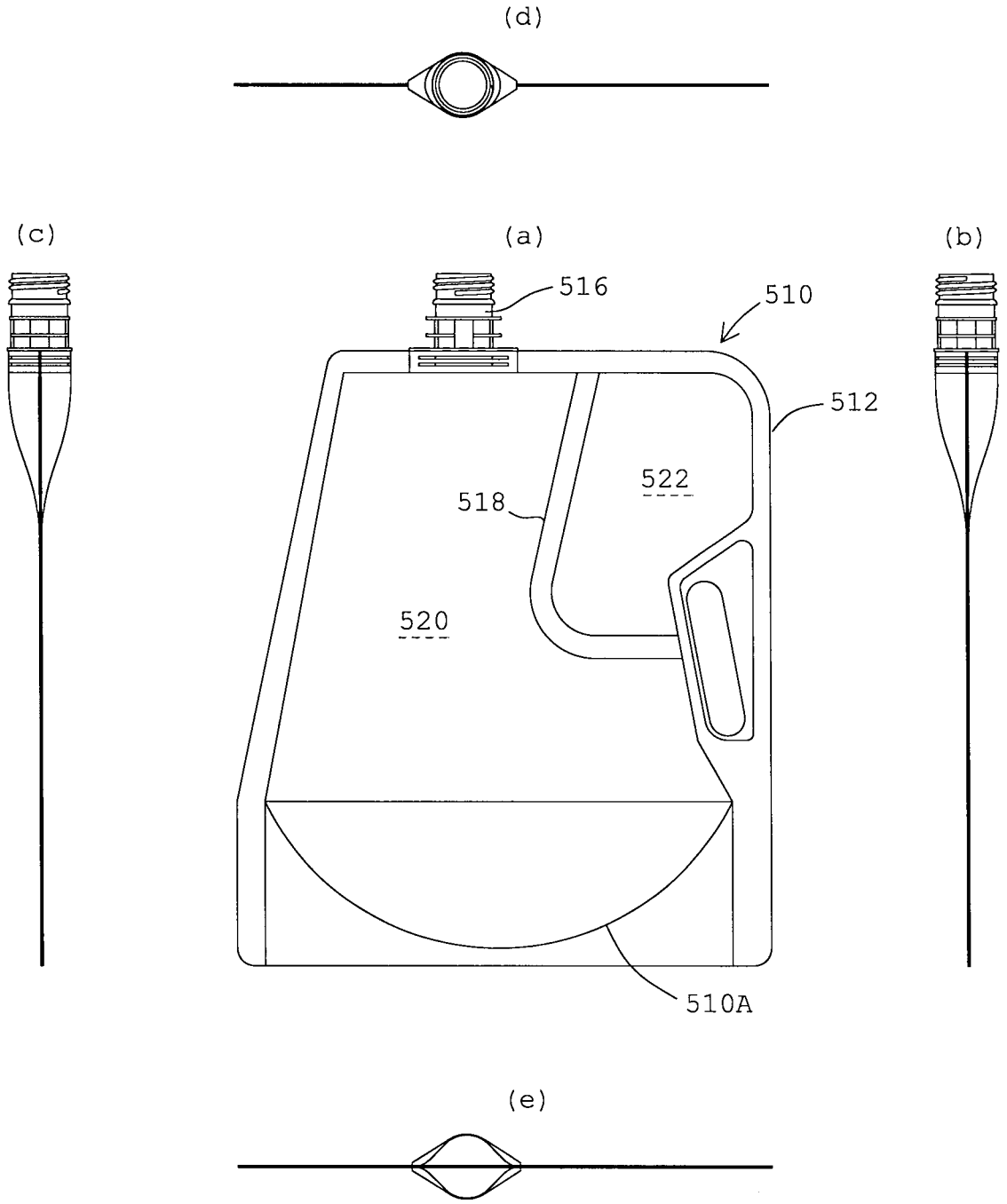
FIGS. 19 (*a*), (*b*), (*c*), (*d*) and (*e*) illustrate front, right side, left side, top and bottom views, respectively, of a multi-cell container in another embodiment of the present invention in the state where no medicine is stored.

FIGS. 17 to 19 also illustrate further embodiments of a multi-cell containers according to the present invention, having bags 310, 410 and 510, respective have peripheral seals (non-separable seals) 312, 412 and 512, respectively on which inlet-outlet ports 316, 416 and 516 are mounted, respectively and partition walls 318, 418 and 518 as separable seals, respectively, each having a horizontal section and a vertical section. The partition walls 318, 418 and 518 separate the spaces inside the bags 310, 410 and 510 into first and second compartments 320, 420 and 520, respectively and 322, 422 and 522, respectively as is similar to the first embodiment. As also similar to the first embodiment (FIG. 9), the bag 310, 410 and 510 have gusseted bottoms 310A, 410A and 510A, respectively. What is different from the first embodiment is in outer profiles of the peripheral seals 312, 412 and 512 and a manner of arrangements of the partition walls 318, 418 and 518. However, these functions are unchanged.

Figure 20:
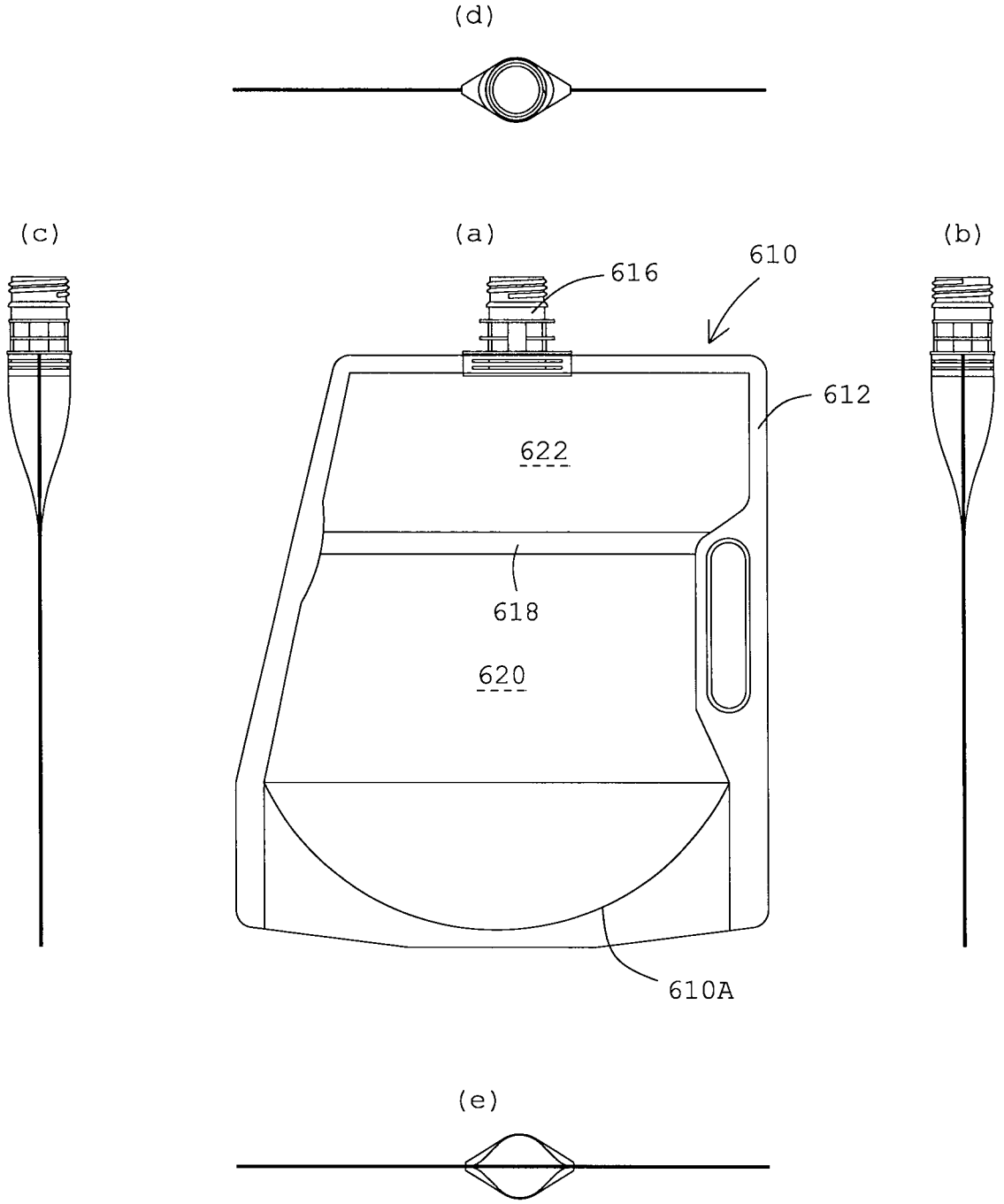
FIGS. 20 (*a*), (*b*), (*c*), (*d*) and (*e*) illustrate front, right side, left side, top and bottom views, respectively, of a multi-cell container in another embodiment of the present invention in the state where no medicine is stored.

FIG. 20 illustrates still further embodiment of a multi-cell container according to the present invention, which has a bag 610 and a peripheral seal 612 (non-separable seal), on which an inlet-outlet port 616 is mounted and a partition wall 618. The partition wall 618 separates the space inside the bag 610 into first and second compartments 620 and 622 and the bag 610 is formed with gusseted bottom 610A, as is similar to every above embodiments. However, unlike any one of the previous embodiments, the partition wall 618 forms an entirely straight seal. The inlet-outlet port 616 opens to the upper compartment 622 of smaller volume above the partition wall 618 and does not open to the lower compartment 620 of larger volume below the partition wall 618. A water introduction from the inlet-outlet port 616 is done to the upper small compartment 622 to solve the powder medicine to obtain its water solution, which is followed by shaking of the bag, so that the partition wall 618 is separated, thereby solving the powder medicine in the lower compartment of a larger volume and completing mixing.

The invention claimed is:

1. A multi-cell container comprising:

a bag of substantially flat shape made of a flexible film, the bag having a non-separable sealed portion extending from a bag bottom portion to a bag top portion along a periphery of the bag;

a separable seal which welds opposite inner surfaces of the bag and forms a partition wall which divides an inner space of the bag into a plurality of compartments; and an inlet-outlet port located in the non-separable sealed portion at the periphery of the bag top portion to be opened to a first compartment of a larger volume of the plurality of compartments for introduction and/or discharge of liquid, wherein the plurality of compartments is formed such that powdery medicines are storable respectively in the plurality of compartments, that a liquid introduced from the inlet-outlet port into the first compartment dissolves one of the powdery medicines to produce a solution in the first compartment, and that a separation of the separable seal causes the solution to be introduced into a second compartment, which is another of the plurality of compartments, to dissolve another of the powdery medicines stored therein, wherein a portion of the bag corresponding to the bag bottom portion is inwardly folded such that a gusseted bottom is formed, and the non-separable sealed portion has a widened portion in a side peripheral portion of the bag between the bag top portion and the bag bottom portion such that the widened portion has an elongated opening for receiving fingers and forms a handle portion, wherein said partition wall is positioned such that said partition wall faces, at least partially, the gusseted bottom of the bag, wherein said partition wall includes a first part that extends horizontally from a side of the bag to a middle portion thereof, and a second part that extends away from the gusseted bottom of the bag, from an end of the first part to a top side of the bag adjacent the inlet-outlet port, wherein the first compartment of the compartments, to which said inlet-outlet port is open, is located on a first side of said partition wall adjacent the gusseted bottom of the bag, and another compartment with no provision of said inlet-outlet port is located on a second side of said partition wall away from the gusseted bottom of the bag, wherein said separable seal as said partition wall has a seal strength in a range between 1 to 5 N/15 mm, wherein the first compartment has a first volume as the larger volume and the second compartment has a second volume less than the first volume of the first compartment, and wherein said one of the powdery medicines stored in the first compartment is polyethylene glycol electrolyte powder.

2. A multi-cell container according to claim 1, wherein said partition further comprises a rounded corner portion at a location where the first and second parts are connected with each other.

3. A multi-cell container according to claim 1, wherein said separable seal has a seal strength which allows the seal to be separated only by shaking the bag in a state where the liquid is introduced into the first compartment, which is said one of the plurality of compartments.

4. A multi-cell container according to claim 1, wherein the separable seal has the seal strength in a range between 1 to 4 N/15 mm.

5. A multi-cell container according to claim 1, wherein the separable seal has the seal strength in a range between 1 to 3 N/15 mm.

6. A multi-cell container according to claim 5, wherein the flexible film is a multi-layer polyethylene film.

7. A multi-cell container according to claim 6, wherein the multi-layer polyethylene film has a thickness of 50 to 200 μm.

8. A multi-cell container according to claim 1, wherein the first part of the partition wall is connected to the handle portion.

9. A multi-cell container according to claim 1, wherein the gusseted bottom forms a base on which the multi-cell container stands in a upright position such that an opening of the inlet-outlet port faces up.

10. A multi-cell container according to claim 1, wherein an angle formed by the first part and the second part of the partition wall is acute.

* * * * *